United States Patent [19]

Theodore

[11] 4,217,864

[45] Aug. 19, 1980

[54] HEATING APPARATUS FOR INTERNAL COMBUSTION ENGINES

[76] Inventor: Vernon M. Theodore, 1627 Dodge St., Dubuque, Iowa 52001

[21] Appl. No.: 958,912

[22] Filed: Nov. 8, 1978

[51] Int. Cl.[2] ..... F01P 11/20

[52] U.S. Cl. ..... 123/41.14; 123/142.5 R

[58] Field of Search ..... 123/41.14, 142.5 R

[56] References Cited

U.S. PATENT DOCUMENTS

| | | | |
|---|---|---|---|
| 1,028,808 | 6/1912 | Campbell | 123/41.14 |
| 1,128,133 | 2/1915 | Hagman | 123/41.14 |
| 1,749,286 | 3/1930 | Hill | 123/41.14 |
| 1,962,932 | 6/1934 | Mather | 123/41.14 |
| 2,093,599 | 9/1937 | Clough | 123/41.14 |
| 3,523,644 | 8/1970 | Kozinski | 123/41.14 |
| 3,853,270 | 12/1974 | Prebil | 123/41.14 |

*Primary Examiner*—Ira S. Lazarus

*Assistant Examiner*—Magdalen Moy

*Attorney, Agent, or Firm*—Henderson & Sturm

[57] ABSTRACT

This invention relates to systems devised to rapidly heat an engine to facilitate the starting thereof. Substantial reduction in vehicle operator effort, in size and quantity of structure required, and in reliance upon moving parts of an engine for actuation of a device, are provided by the invention. An accumulator reservoir (26) is coupled to an insulated fluid storage reservoir (28) which in turn is coupled to the engine cooling system. A circuit (51) opens the valve structure (31), the accumulator (26) forcing fluid coolant out of the reservoir (28) into the cooling system, the circuit (51) disabling ignition of the engine until the coolant system is filled. Upon shutdown of the engine, the circuit (51) after a time delay operates a pump (41) to move the coolant back into the reservoir (28) where the coolant is stored at an elevated temperature.

7 Claims, 4 Drawing Figures

HEATING APPARATUS FOR INTERNAL COMBUSTION ENGINES

DESCRIPTION

Technical Field and Background Art

This invention relates to systems for heating and cooling internal combustion engines. More particularly, this invention relates to systems devised to rapidly heat an engine to facilitate the starting thereof. Such systems have included tanks connected to the cooling system of the engine, as shown by U.S. Pat. Nos. 1,455,335, 1,625,737, 1,749,286, 2,016,179, 3,498,539 and 3,853,270. However, methods employed therein for effecting movement of cooling system fluid relative to the tanks have been cumbersome and often have involved manual effort on the part of the vehicle operator.

DISCLOSURE OF INVENTION

The heating apparatus, for internal combustion engines, of this invention includes an air accumulator tank connected to an insulated reservoir. A valve structure communicates with the engine cooling system directly and also through a pump. The valve structure is also connected to the reservoir. A control system senses coolant fluid levels in the engine cooling system and operates to actuate the valve structure whereby fluid flows from the reservoir into the engine cooling system and to actuate the pump whereby fluid is drawn back into the reservoir.

It is an object of this invention to provide an apparatus which more effectively heats an engine to facilitate engine starting when the engine is subjected to cold ambient air temperatures.

Another object of this invention is to provide an apparatus which employs air pressure to cause cooling system fluid to move from a position of storage to the engine cooling system, thereby eliminating physical exertion by the vehicle operator and other, cumbersome, mechanical apparatus for effecting same.

These objects and other features and advantages of the heating apparatus of this invention will become readily apparent upon referring to the following description, when taken in conjunction with the appended drawings.

BRIEF DESCRIPTION OF DRAWINGS

The heating apparatus, for internal combustion engines, of this invention is illustrated in the drawing wherein.

BEST MODE FOR CARRYING OUT THE INVENTION

Figure 1:
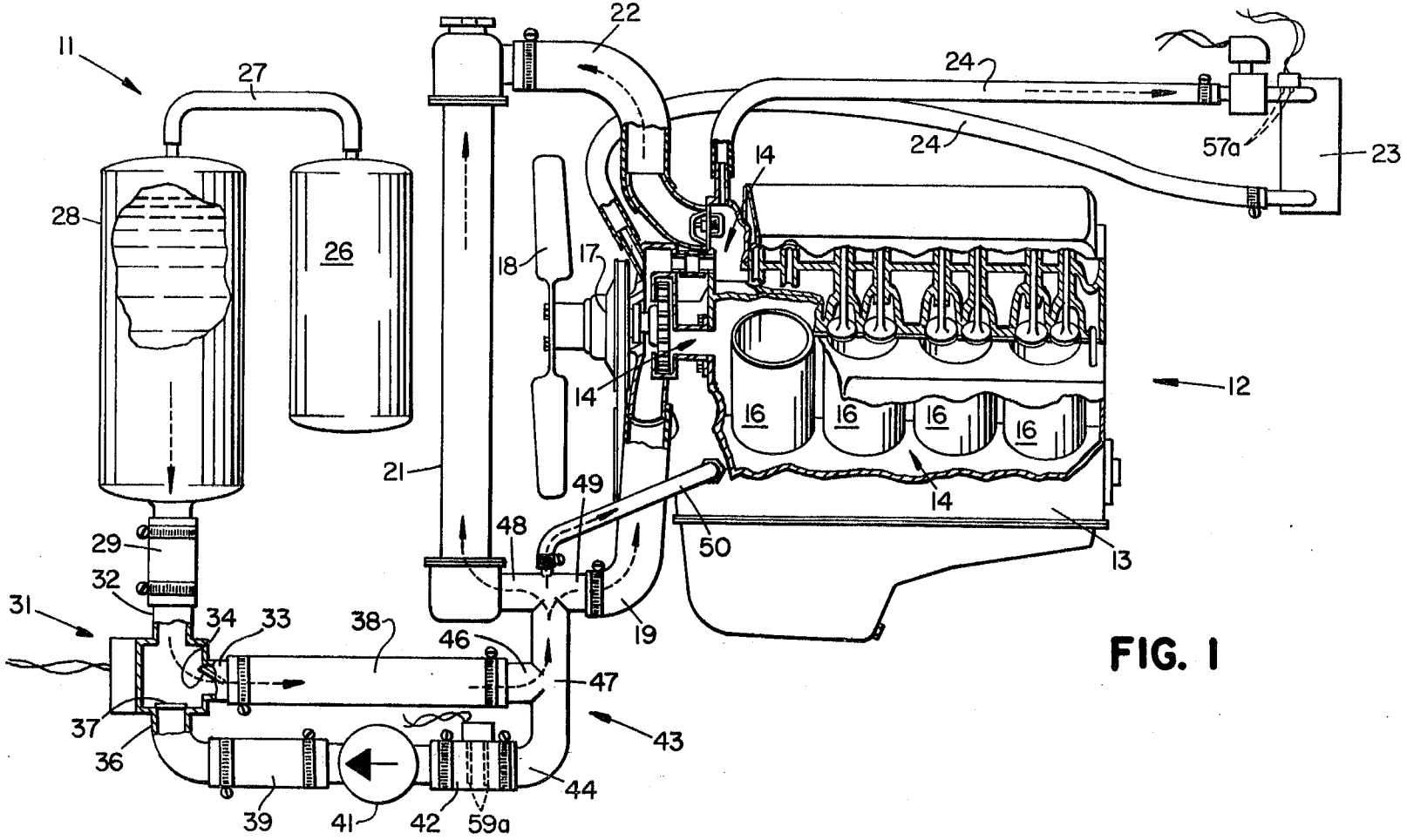
FIG. 1 is a side elevational view, partly cut away, and partly schematic, showing the heating apparatus and charge cycle.
Figure 2:
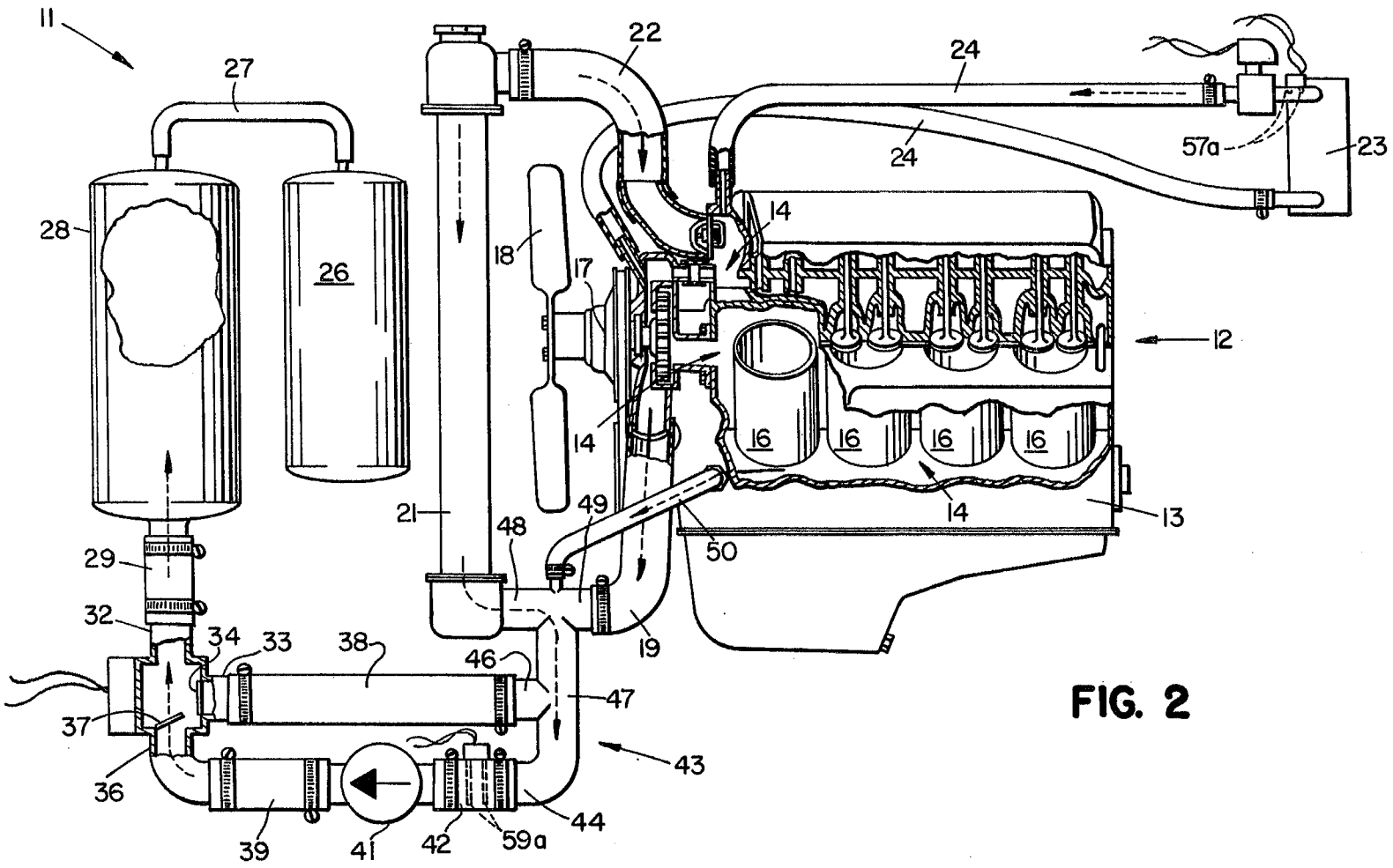
FIG. 2 is a side elevational view, partly cut away, and partly schematic, showing the heating apparatus and discharge cycle.

Referring now to FIGS. 1 and 2, the heating apparatus of this invention is shown generally at 11 connected to a liquid-cooled, internal combustion engine 12. The engine 12 includes a block 13 having a jacket, or plurality of passages 14 for coolant fluid formed therein. The passages 14 are disposed about the cylinders 16 of the engine 12. The passages 14 communicate with the water pump 17 and fan 18 structure and with the return 19 to the radiator 21. Another hose 22, disposed away from the return 19, extends between the radiator 21 and the passages 14 within the engine block 13. The heater core 23 is connected by hoses 24 to the passages 14.

The heater apparatus 11 more particularly includes an air accumulator reservoir 26. The reservoir 26 is mounted upon the vehicle (not shown) bearing the engine 12. The reservoir 26 is illustrated herein as being cylindrical; however, other conformations maybe employed. Formed through one end of the reservoir 26 is a port over which a pneumatic hose 27 is attached.

The heater apparatus 11 also includes a double-walled, vacuum insulated reservoir 28. The reservoir 28 also is illustrated herein as being cylindrical, but again, otherconformations may be employed. The reservoir 28 has ports formed through each end. The pneumatic hose 27 is attached over one port, and a hose 29 is attached over, and extends from, the opposite port.

A valve structure 31 includes a first port 32 over which the hose 29 is attached, the interiors of structure 31 and reservoir 28 being fluid-coupled thereby. The valve structure 31 includes a second port 33 having a solenoid valve 34 disposed therein. The valve structure 31 also includes a third port 36 having a check valve 37 disposed therein. Connecting hoses 38, 39 are attached over, and extend from, ports 33, 36 respectively. A one-way electric pump 41 is coupled to the extended end of hose 39, and another hose 42 extends from the opposite side of pump 41.

The heating apparatus 11 also includes a coupling structure 43. First and second port portions 44, 46 communicate with a longitudinally elongated body portion 47. Disposed away from ports 44, 46 and attached adjacent an end of portion 47 are ports 48, 49. Connecting hose 38 is attached over second port 46. Pump connecting hose 42 is attached over first port 44. Ports 48, 49 form part of return 19, port 48 being connected to radiator 21 directly or by hose, port 49 being connected similarly to the water pump 17. Hose 50 extend from the block 13, communicate with the lowest part of the jacket 14, and are coupled to the return 19.

An electronic control circuit includes the automobile accessory switch 52 coupled through a first time delay relay coil 53 to ground. The engine charge switch 54 is connected in series to switch 52 and through solenoid valve coil 34 to ground in parallel with coil 53. Relay coil 53 operates two switches **53*a*, 53*b*. Switch 53*a* is connected in series with the air vent solenoid valve coil 56 and the Darlington amplifier configuration air vent water sensor 57 to ground. A second relay coil 58 operates switch 58*a* and is connected to ground through a Darlington amplifier configuration electric pump area water sensor 59. A third relay coil 61 operates switches 61*a*, 61*b* and is connected in parallel with coil 56. Switch 61*a* is connected in series between switch 54 and coil 34. Switch 61*b* is connected in series with the standard automobile starter relay coil and associated circuitry 62. Switches 58*a* and 53*b* are connected in series through motor 41** to ground.

Figure 3B:
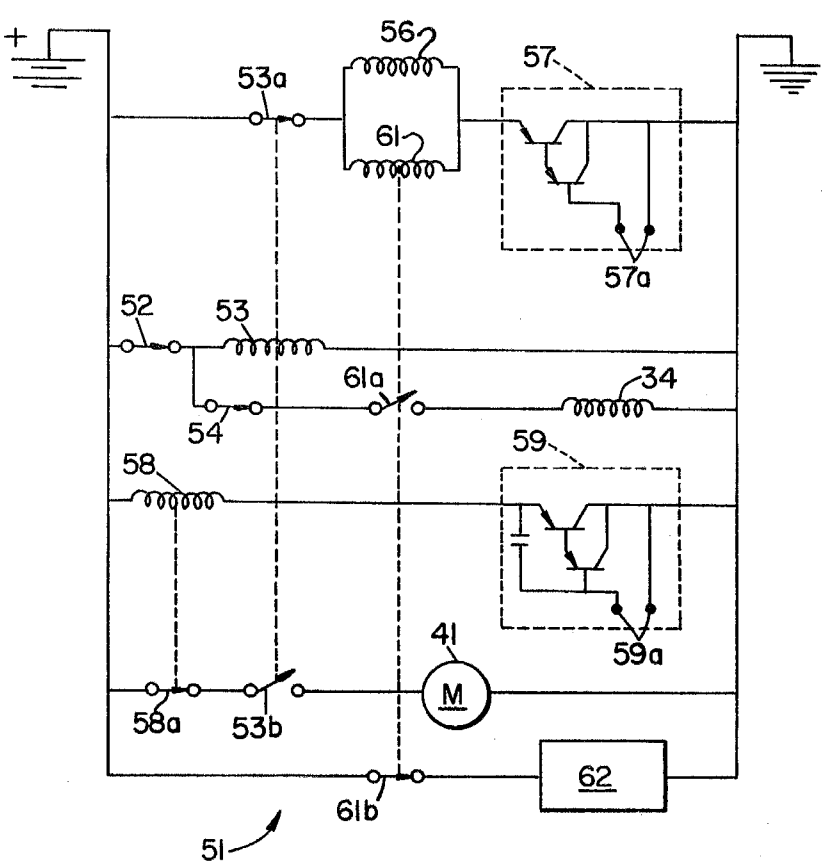
FIG. 3 is a schematic of the circuitry of the heating apparatus.
Figure 3A:
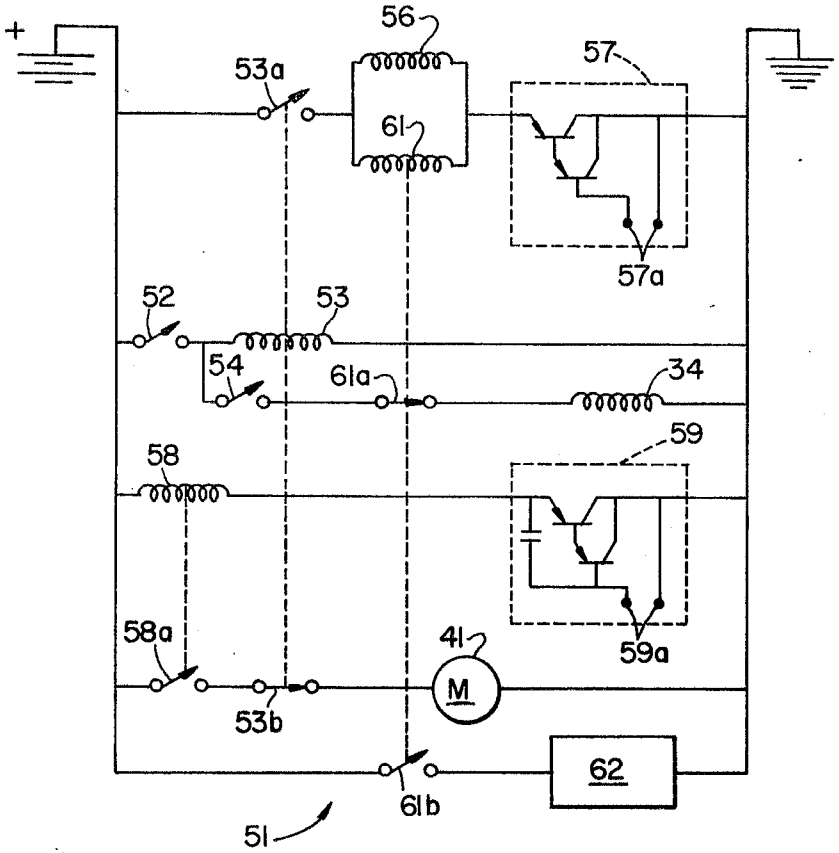

When the automobile is parked and the engine 12 shutoff, the heating apparatus 11 operates in the discharge cycle. Referring to FIG. 3A, when the vehicle operator turns off the ignition switch, switches 52, 54 open. Coil 53 is deenergized, allowing normally closed switch **53*b* to close. After a time delay, preferably of about one minute, the normally open time-delayed switch 53***a* opens. Opening of contact 53*a* causes solenoid 56 to open the heater air vent and deenergizes coil 61. Normally closed contact 61*a* then closes, and normally open contact 61*b* then opens. As coolant fluid is present at sensors 59*a*, coil 58 is energized, and normally open contact 58*a* is closed. Therefore, closing of contact 53*b* causes the electric motor 41 to drive the pump. As shown in FIG. 1, the fluid within the passages 14, radiator 21, heater core 23 and connecting hoses is driven by pump 41 through the check valve 37 of port 36 into valve 31, through hose 29 and into reservoir 28, air being driven before the fluid through hose 27 into air accumulator reservoir 26. The pump 41 continues to run until the input side thereof runs dry. The sensors 59*a* of the water sensor 59 extend into, and depend to adjacent the bottom wall of hose 42, and absence of fluid breaks a circuit therebetween. Water sensor 59 deenergizes coil 58, causing contact 58*a* to open (as illustrated in FIG. 3A), thereby shutting off pump 41. The fluid is now in storage location within reservoir 28.

When the vehicle is to be operated again, the heating apparatus 11 goes through the charge cycle. Referring to FIG. 3B, when the vehicle operator turns the ignition switch, switch 52 closes. Coil 53 is energized, causing contact 53*a* to close and contact 53*b* to open, thereby preventing pump motor 41 from operating. Coils 56, 61 do not energize until fluid is sensed at 57*a*. The vehicle operator turns the engine charge swith 54 on. Solenoid valve 34 is energized to open, thereby permitting fluid to travel therethrough. As shown in FIG. 2, air within accumulator 26 forces, through hose 27, fluid out of the reservoir 28 and through valve port 33, check valve 37 preventing flow through port 36. The fluid then, by way of coupling structure 43, fills the passages 14, radiator 21, heater core 23 and connecting hoses. Fluid is detected at sensors 59, and energized coil 58 causes contact 58*a* to close. When fluid is detected at sensors 57*a*, solenoid 56 closes the air vent, and coil 61 operates to open switch 61*a*, thereby causing solenoid valve 34 to close. Contact 61*b* is closed, thereby permitting starting of the engine 12.

It is preferred that the volume of the accumulator reservoir 26 be about 83% of that of the storage reservoir 28, which reservoir 28 is of a capacity such that it is filled when the cooling system of the engine 12 is emptied of fluid. A pressure of about 18 psi. (about 1.2bar) is provided thereby. If the vehicle engine is larger than that of a standard automobile, the relative size of reservoirs 26, 28 is varied to provide greater pressure. The engine 12 illustrated is V-8 in configuration, but the invention 11 may be employed in other types of internal combustion engines. The motor 41 presently contemplated may pump about 8 gal. (about 29 liters) per minute. A preferred coolant fluid would be about 85% water and 15% commercial anti-freeze. Solenoid and relay coils capable of handling 2 amp. currents are preferable. The sensor circuits 57, 59 are preferably solid state. A capacitor may extend between the sensors 57*a*, and the value of such a capacitor, as well as of the capacitor of sensor circuit 59, is preferably about 0.01 microfarad.

An average running temperature for a standard size V-8 engine is in the neighborhood of 195° F. (about 91° C.). When the engine is shut off, the coolant fluid increases in temperature initially before cooling down, and, about one minute after the engine is shut-off, reaches a maximum temperature. For the foregoing running temperature example, the maximum temperature would be in the neighborhood of 210° F. (about 99° C.). The discharge cycle of the invention 11, because of the time delay, results in coolant fluid being removed to storage reservoir 28 at a maximum temperature. The temperature of the coolant fluid remains substantially elevated within the vacuum-insulated double wall storage reservoir 28 for substantial periods of time. Double wall tanks are now available which are capable limiting temperature loss to 5° F. for a 36 hour period in −20° F. weather. The relatively hot coolant fluid, reintroduced into the cooling system of the engine 12, elevates the temperature thereof, particularly the cylinder walls 16, thereby reducing friction and facilitating starting of the engine 12 in cold weather.

The accumulator reservoir 26 effectively drives the coolant back into the engine 12 cooling system. No manual labor is required of the vehicle operator other than the actuation of a switch. Furthermore, the reservoir 26 is not operated by any of the moving parts of the engine 12. Although the vehicle battery is employed to operate the control circuit 51, the pump 41 is only operated for short periods, and little strain is placed on the battery.

Although a best mode and modifications thereof have been disclosed herein, it is to be remembered that various alternate constructions can be made thereto without departing from the full scope of the invention, as defined in the appended claims.

I claim:

1. A heat-assisted starting apparatus for a liquid-cooled internal-combustion engine including a liquid cooling system, an insulated reservoir capable of holding a substantial volume of the cooling system coolant, and coolant-transfer and retransfer means operative in a first cycle for discharging coolant from the cooling system to the reservoir incident to engine shut-down and in a second cycle for charging the cooling system from the reservoir incident to engine start-up, the improvement comprising: an accumulator liquid-connected to the reservoir; pump means serving in the first cycle and connected between the cooling system and the reservoir for discharging coolant from the cooling system to the reservoir and simultaneously pressurizing the accumulator; coolant-charge means connected between the reservoir and operative in the second cycle, independently of the pump means and under pressure stored in the accumulator during operation in the first cycle, for charging the cooling system from the reservoir; and control means selectively operative for selecting between operation in said first and second cycles.

2. The apparatus of claim 1, the further improvement comprising means associated with the coolant-charge means for by-passing the pump during operation in the second cycle.

3. The apparatus of claim 1, the further improvement comprising time-delay means associated with the control means and responsive to a preselected rise in coolant temperature following engine shut-down to delay operation in the first cycle.

4. The apparatus of claim 3, the further improvement comprising means responsive to a preselected diminution of coolant in the coolant system during the first cycle for automatically stopping operation of the pump means.

5. The apparatus of claim 1, the further improvement comprising time-delay means associated with the control means for delaying starting of the engine following operation in the second cycle until the cooling system has been charged with a preselected volume of coolant.

6. The apparatus of claim 1, the further improvement comprising valve means in the control means selectively connectible to effectuate the pump means discharge and the coolant charge means.

7. The apparatus of claim 1, the further improvement comprising first time-delay means associated with the control means and responsive to a preselected rise in coolant temperature following engine shut-down to delay operation in the first cycle until said temperature is attained, and second time-delay means associated with the control means for delaying starting of the engine following operation in the second cycle until the cooling system has been charged with a preselected volume of coolant.

* * * * *